US006421023B1

(12) United States Patent
Phelan

(10) Patent No.: US 6,421,023 B1
(45) Date of Patent: Jul. 16, 2002

(54) PHASE SHIFTER AND ASSOCIATED METHOD FOR IMPEDANCE MATCHING

(75) Inventor: Harry Richard Phelan, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/735,396

(22) Filed: Dec. 11, 2000

(51) Int. Cl.[7] ..... H01Q 1/00

(52) U.S. Cl. ..... 343/787; 343/700 MS; 343/778

(58) Field of Search ..... 343/700 MS, 753, 343/754, 909, 787, 778; 156/89.14

(56) References Cited

U.S. PATENT DOCUMENTS

| | | | | |
|---|---|---|---|---|
| 4,323,901 A | | 4/1982 | DeWames et al. | 343/754 |
| 5,206,613 A | | 4/1993 | Collier et al. | 333/156 |
| 5,305,009 A | | 4/1994 | Goutzoulis et al. | 342/157 |
| 5,309,166 A | | 5/1994 | Collier et al. | 343/778 |
| 5,450,092 A | | 9/1995 | Das | 343/787 |
| 5,451,567 A | | 9/1995 | Das | 505/210 |
| 5,472,935 A | | 12/1995 | Yandrofski et al. | 505/210 |
| 5,550,792 A | | 8/1996 | Crandall et al. | 367/155 |
| 5,557,286 A | | 9/1996 | Varadan et al. | 343/700 |
| 5,589,845 A | | 12/1996 | Yandrofski et al. | 343/909 |
| 5,617,103 A | | 4/1997 | Koscica et al. | 343/700 |
| 5,680,141 A | | 10/1997 | Didomenico et al. | 342/372 |
| 5,693,429 A | | 12/1997 | Sengupta et al. | 428/699 |
| 5,694,134 A | | 12/1997 | Barnes | 343/700 |
| 5,696,737 A | | 12/1997 | Hossack et al. | 367/138 |
| 5,729,239 A | | 3/1998 | Rao | 343/753 |
| 5,731,790 A | | 3/1998 | Riza | 342/368 |
| 5,766,697 A | | 6/1998 | Sengupta et al. | 427/585 |
| 5,830,591 A | | 11/1998 | Sengupta | 428/701 |
| 5,846,893 A | | 12/1998 | Sengupta et al. | 501/137 |
| 5,856,955 A | | 1/1999 | Cole et al. | 367/138 |
| 5,887,089 A | | 3/1999 | Deacon et al. | 385/22 |
| 6,160,524 A | * | 12/2000 | Wilber | 343/787 |
| 6,329,959 B1 | * | 12/2001 | Varadan et al. | 343/787 |
| 6,350,335 B1 | * | 2/2002 | Hampel et al. | 156/89.14 |

OTHER PUBLICATIONS

Keuls et al., "($YBa_2Cu_3O_{7-\delta}Au$)/$SrTiO_3$/$LaAlO_3$ Thin Film Conductor/Ferroelectric Coupled Microstripline Phase Shifters For Phased Array Applications" Applied Physics Letters, American Institute of Physics, New York, US, vol. 71, no. 21, Nov. 24, 1997, pp. 3075–3077.

Kozyrev et al. "Application of Ferroelectrics in Phase Shifter Design"2000 IEEE MIT–S International Microwave Symposium Digest, IMS 2000, Boston, MA, Jun. 11–16, 2000, IEEE MIT–S International Microwave Symposium , New York, vol. 3 of 3, Jun. 11, 2000, pp. 1355–1358.

* cited by examiner

*Primary Examiner*—Don Wong
*Assistant Examiner*—Hoang Nguyen
(74) *Attorney, Agent, or Firm*—Allen, Dyer, Doppelt, Milbrath & Gilchrist, P.A.

(57) ABSTRACT

A transmission line phase shifter includes a substrate, and first and second conductive portions adjacent the substrate with a gap therebetween. The first and second conductive portions define a signal path. A body is in the gap and includes a phase shifting material having a controllable dielectric constant for causing a phase shift of a signal through the signal path. The body has an enlarged width medial portion tapering downwards in width towards respective end portions for impedance matching with the first and second conductive portions. The width of the tapered end portions of the phase shifting material body are selected so that a separate impedance matching network is not required for impedance matching with the first and second conductive portions.

60 Claims, 4 Drawing Sheets

PHASE SHIFTER AND ASSOCIATED METHOD FOR IMPEDANCE MATCHING

FIELD OF THE INVENTION

The present invention relates to the field of antennas, and, more particularly, to a phase shifter for a phased array antenna.

BACKGROUND OF THE INVENTION

Phased array antennas are well known, and are commonly used in satellite, electronic warfare, radar and communication systems. A phased array antenna includes a plurality of antenna elements and respective phase shifters that can be adjusted for producing a steerable antenna beam in a desired direction.

A scanning phased array antenna steers or scans the direction of the RF signal being transmitted without physically moving the antenna. Likewise, the scanning phased array antenna can be steered or scanned without physically moving the antenna so that the main beam of the phased array antenna is in the desired direction for receiving an RF signal. This enables directed communications in which the RF signal is electronically focused in the desired direction.

One type of phase shifter includes switching diodes and transistors that change the path length, and thus the phase shift through the phase shifter via bias current changes. Another type phase shifter includes a phase shifting material that produces a phase shift via a DC static voltage applied across the material. A variable voltage applied to the phase shifting material induces a change in its dielectric constant. As a result, an RF signal being conducted through the transmission line phase shifter exhibits a variable phase delay. In other words, the electrical length of the transmission line can be changed by varying the applied voltage.

A conventional phase shifter 10 will now be discussed with reference to FIG. 1. The prior art phase shifter 10 includes an RF signal input path 12 and an RF signal output path 14. A phase shifting material 16 is between the RF signal input and output paths 12, 14. A bias network 18 is connected to the phase shifting material 16 for applying a voltage thereto for controlling the dielectric constant.

A respective impedance matching network 20 is required to match the impedance of the phase shifting material 16, and the RF signal input and output paths 12, 14. The transmission line when loaded by the phase shifting material 16 typically has a low impedance in a range of about 1 to 10 ohms, whereas the impedance of the RF signal input and output paths 12, 14 is about 50 ohms. Consequently, the two impedance matching networks 20 are required.

However, a problem arises where space and power are at a premium, particularly in airborne platforms. A typical phased array antenna requires several thousand antenna elements, each with its own phase shifter. The impedance matching networks 20 required for each phase shifter 10 increases the length of the phase shifter by a factor of 4 as compared to the phase shifting material 16 alone. For example, the phase shifting material 16 has a dielectric constant of about 400 and is typically about 0.4 inches in length for an RF signal having an operating frequency of 10 GHz, but with the addition of the impedance matching networks 20, the overall length of the phase shifter 10 may be increased to about 2.4 inches. Moreover, it is readily understood by those skilled in the art that the length of the phase shifter may be calculated by recognizing that 0.4 inches in length will change the insertion phase by 10% of its length.

In addition to the impedance matching networks 20 adding to the physical size and weight of each transmission line phase shifter 10, attenuation losses of the RF signal being conducted through the transmission line phase shifter also increase. Consequently, a larger drive voltage is required to overcome the losses introduced by the impedance matching networks 20. This in turn adds to the overall cost of each transmission line phase shifter 10.

Unfortunately, phased array antennas are limited in their application primarily by cost. Even using the latest monolithic microwave integrated circuit (MMIC) technology, an individual phase shifter may have a unit cost in excess of $500. With a typical phased array antenna requiring several thousand antenna elements, each with its own phase shifter, the price of the phased array antenna quickly becomes very expensive.

SUMMARY OF THE INVENTION

In view of the foregoing background, it is therefore an object of the present invention to provide a phase shifter that is smaller in size as compared to a conventional phase shifter.

Another object of the present invention is to provide a phase shifter with reduced RF signal attenuation losses as compared to a conventional phase shifter.

A further object of the present invention is to provide a phased array antenna at a significantly lower cost than a conventional phased array antenna.

Yet another object of the present invention is to provide a method for making a phase shifter that overcomes size and attenuation losses introduced with a conventional phase shifter.

These and other objects, advantages and features in accordance with the present invention are provided by a transmission line phase shifter comprising a substrate, and first and second conductive portions adjacent the substrate with a gap therebetween. The first and second conductive portions define a signal path. A body comprising a phase shifting material is preferably in the gap and has a controllable dielectric constant for causing a phase shift of a signal through the signal path.

The body preferably has an enlarged width medial portion tapering downwards in width towards respective end portions for impedance matching with the first and second conductive portions. The width of the tapered end portions of the body are preferably selected so that a separate impedance matching network is not required for impedance matching with the first and second conductive portions.

The body in accordance with the present invention advantageously combines the functions of phase shifting the signal being conducted therethrough and impedance matching with the first and second conductive portions. The first and second conductive portions each preferably has an impedance of about 50 ohms. The enlarged width medial portion of the phase shifting material body preferably has an impedance in a range of about 1 to 10 ohms.

In other words, the width of the tapered end portions of the phase shifting material body are preferably selected so that a separate impedance matching network is not required for impedance matching with the first and second conductive portions. The opposing ends of the first and second conductive portions adjacent the gap also preferably have a reduced width that corresponds to a width of the end portions of the body. Because an impedance matching network is not required, the length of the phase shifter may be significantly reduced by at least a factor of 4. This allows construction of a lower cost, much smaller and lower loss phase shifter.

In one embodiment, the body preferably comprises a substrate with a layer of the phase shifting material thereon. In another embodiment, the body comprises a bulk phase shifting material body.

The phase shifting material preferably comprises a ferroelectric material, such as barium strontium titanate, or a ferromagnetic material. The body may have an overall thickness equal to or greater than about 0.002 inches. Because the body has a thickness that is relatively easy to handle, the body may be simply bonded to the substrate exposed by the gap between the first and second conductive portions.

Consequently, in forming a phased array antenna, the bodies are preferably loaded into production surface mount or similar machines. The present invention is thus very adaptable to mass production using techniques as readily understood by one skilled in the art.

Each phase shifter preferably further comprises at least one third conductive portion adjacent the substrate for defining a ground structure. In one embodiment, the at least one third conductive portion preferably comprises a pair of laterally spaced apart third conductive portions along opposing sides of the signal path. This defines a coplanar waveguide structure. Each of the pair of laterally spaced apart third conductive portions may also have a recess adjacent and corresponding to the enlarged width medial portion of the body. In another embodiment, the signal path vertically extends from the third conductive portion for defining a microstrip structure.

Another aspect of the invention relates to a method for making a phase shifter. The method preferably comprises forming first and second conductive portions adjacent a substrate with a gap therebetween. The first and second conductive portions define a signal path.

The method further preferably includes inserting a body in the gap. The body preferably comprises a phase shifting material having a controllable dielectric constant for causing a phase shift of a signal through the signal path. The phase shifting material body preferably has an enlarged width medial portion tapering downwards in width towards respective end portions for impedance matching with the first and second conductive portions.

In one embodiment, the body may have a diamond shape. Inserting body may be performed using a surface mount machine. Each body may also have a thickness equal to or greater than about 0.002 inches.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime and multiple prime notations are used in alternate embodiments. The dimensions of layers and regions may be exaggerated in the figures for greater clarity.

A phased array antenna 40 and a transmission line phase shifter 42 in accordance with the present invention will be discussed with reference to FIGS. 2 through 6*b*. The phased array antenna 40 comprises a plurality of antenna elements 44*a*–44*n* and a plurality of phase shifters 42*a*–42*n* connected to the plurality of antenna elements.

Each phase shifter 42*a*–42*n* comprises a substrate 46, and first and second conductive portions 48*a*, 48*b* adjacent the substrate with a gap therebetween. The first and second conductive portions 48*a*, 48*b* define a signal path. A body 50 is in the gap and comprises a phase shifting material having a controllable dielectric constant for causing a phase shift of a signal being through the signal path.

Figure 3:
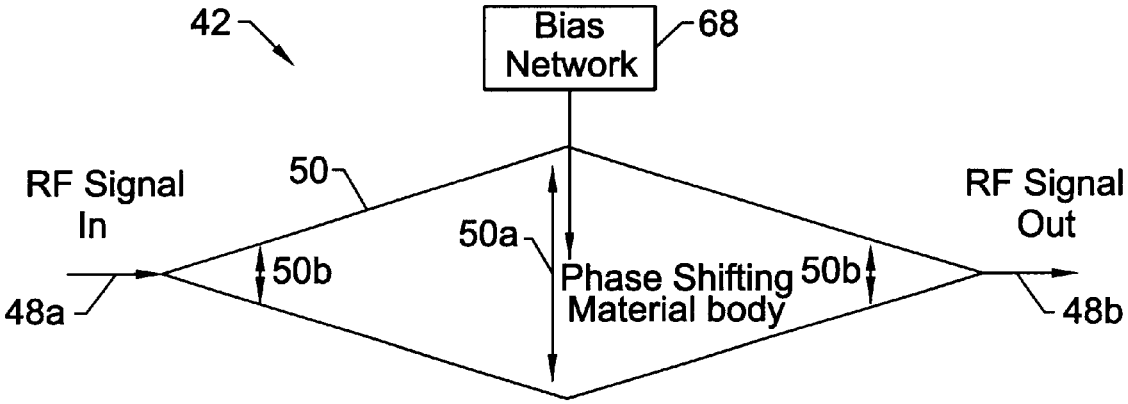
FIG. 3 is a functional block diagram of a phase shifter in accordance with the present invention.

The body 50 has an enlarged width medial portion 50*a* tapering downwards in width towards respective end portions 50*b* for impedance matching with the first and second conductive portions 48*a* and 48*b*, as best shown in FIG. 3. The opposing ends of the first and second conductive portions 48*a*, 48*b* adjacent the gap preferably have a reduced width that corresponds to a width of the end portions 50*a*, 50*b* of the body 50.

Figure 4A:
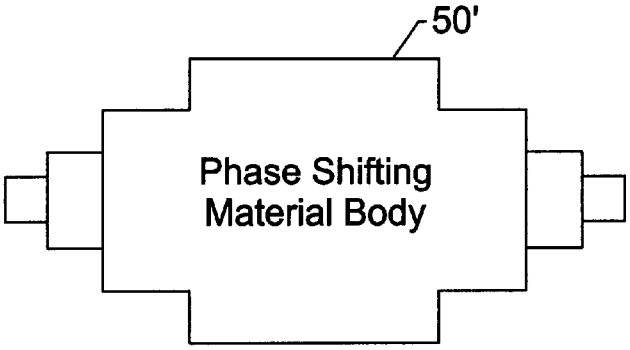
FIGS. 4*a* and 4*b* illustrate alternative shapes of the phase shifting material body illustrated in FIG. 3.
Figure 4B:
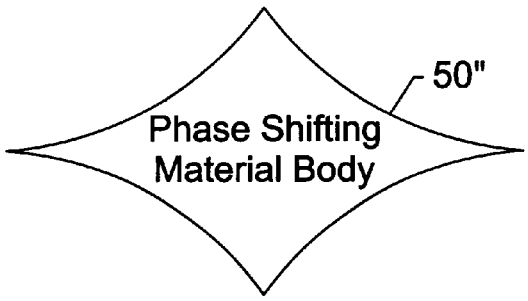

In this particular embodiment, the body 50 has a diamond shape. Alternative shapes of the body 50 include a short step taper (50'), as best shown in FIG. 4*a*, and a Tschebechev or Taylor taper (50"), as best shown in FIG. 4*b*. Other shapes and configurations are also applicable for the phase shifting material body 50, as readily appreciated by one skilled in the art. For example, the body would have a tapered cylindrical shape for a circular waveguide operating with a dominant $TE_{10}$ mode.

The phase shifting material body 50 in accordance with the present invention advantageously combines the functions of phase shifting the signal being conducted therethrough and impedance matching with the first and second conductive portions 48*a*, 48*b*. The first and second conductive portions 48*a*, 48*b* each has an impedance of about 50 ohms. The enlarged width medial portion 50*a* of the phase shifting material body 50 has an impedance in a range of about 1 to 10 ohms.

An advantageous effect of the phase shifters as described herein is that when the impedance changes along the transmission line, the phase shift versus frequency becomes somewhat non-linear, thus producing more phase shift versus impressed voltage. This useful effect also reduces the overall shifter length and loss.

In other words, as the width of the body 50 decreases from the enlarged width medial portion 50*a* to the tapered end portions 50*b*, the impedance increases. Impedance versus width of the phase body 50 is readily understood by those skilled in the art. Therefore, the width of the tapered end portions 50*b* of the body 50 can be selected so that a separate impedance matching network 20 is not required for impedance matching with the first and second conductive portions 48*a*, 48*b*. Because an impedance matching network 20 is not required, the length of the phase shifter 42*a*–42*n* may be significantly reduced by at least a factor of 4.

Figure 1:
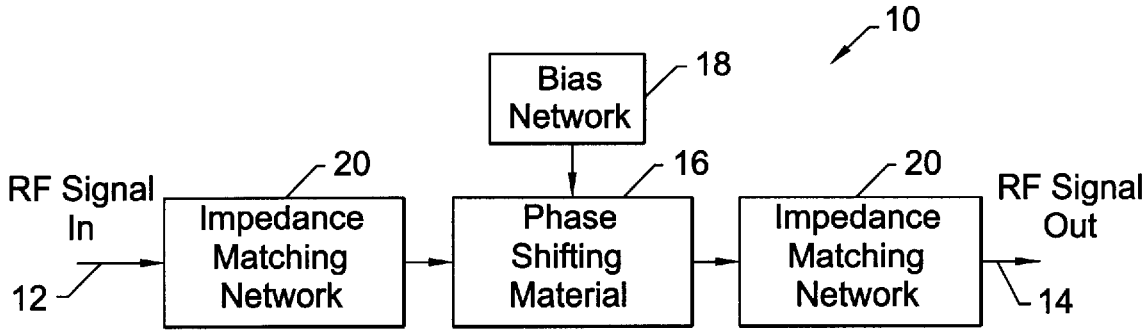
FIG. 1. (PRIOR ART)
FIG. 1 is a functional block diagram of a phase shifter in accordance with the prior art.
Figure 2:
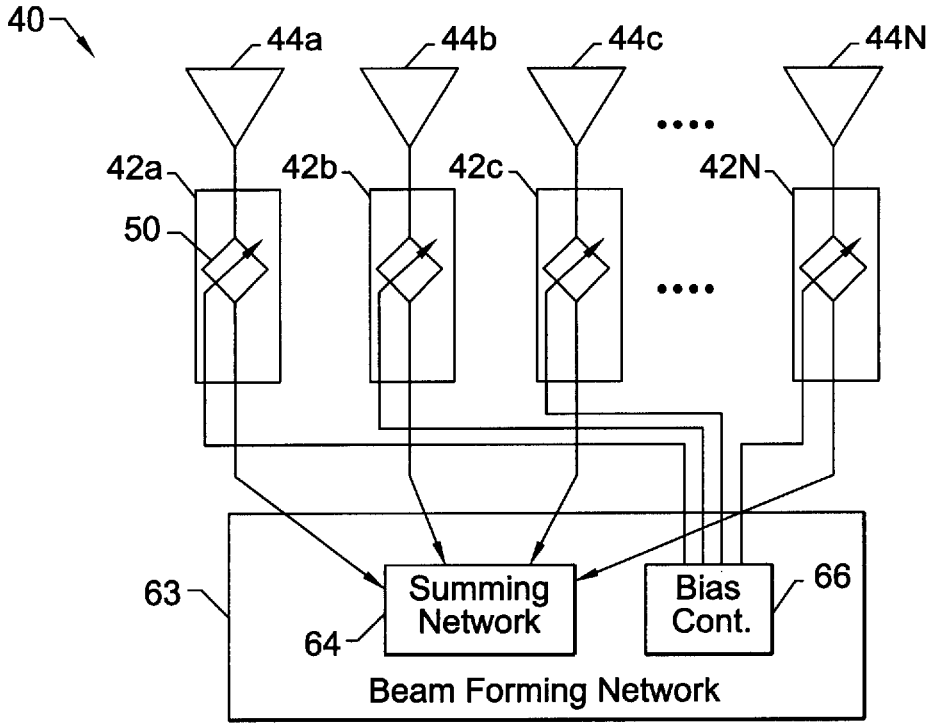
FIG. 2 is a simplified functional block diagram of a phased array antenna in accordance with the present invention.

The overall length of the conventional phase shifter 10 illustrated in FIG. 1 has a length of about 2.4 inches. Without the impedance matching networks 20, the length of the phase shifter 42*a*–42*n* in accordance with the present invention is reduced to a length of about 0.6 inches. However, the actual reduction in size of the phase shifter 42*a*–42*n* will vary depending on the intended operating wavelength, as readily understood by those skilled in the art.

In addition to reducing the size and weight of each phase shifter 42*a*–42*n*, the attenuation losses of the signal being conducted therethrough also decrease. Consequently, a lower drive voltage is required. For example, the conventional phase shifter 10 required a drive voltage of about 400 volts at an operating frequency of about 10 GHz. The drive voltage for the phase shifter 42*a*–42*n* in accordance with the present invention is about 100 volts. This in turn collectively helps to reduce the overall cost of each phase shifter 42*a*–42*n*.

The phase shifting material of each body 50 preferably comprises a ferroelectric material, such as barium-strontium titanate, or a ferromagnetic material. The body 50 may have an overall thickness greater than about 2 mils, i.e., 0.002 inches, so that it is easier to handle. More specifically, the enlarged width medial portion 50*a* of the phase shifting material body 50 has a width that is in a range of about 50 to 150 times a width of the end portions 50*b* of the phase shifting material body. The phase shifting material body 50 has a length that is in a range of about 5 to 15 times an operating wavelength of the phase shifter 42*a*–42*n*.

Figure 5A:
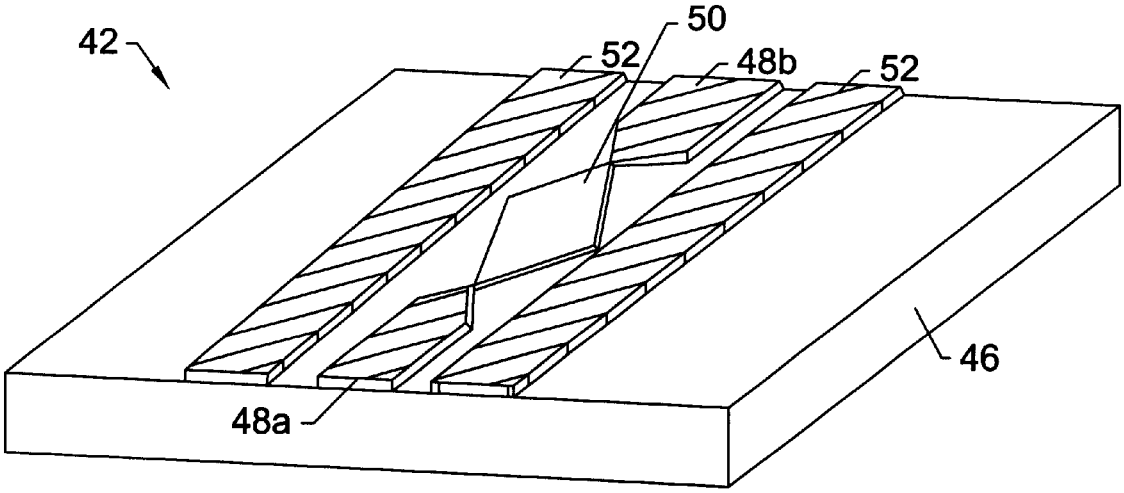
FIGS. 5*a*–5*c* are perspective views of various embodiments of the transmission line phase shifter in accordance with the present invention.
Figure 5B:
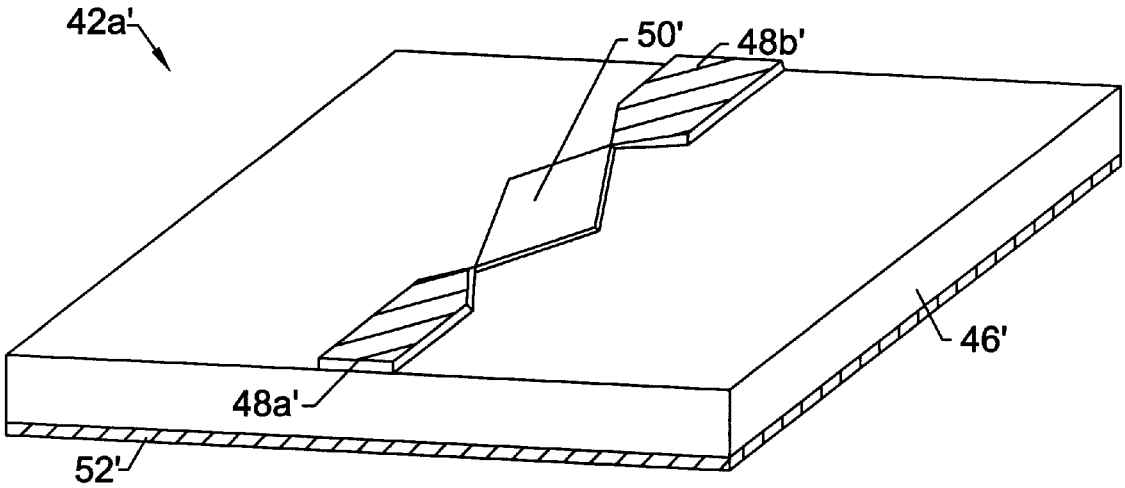
Figure 5C:
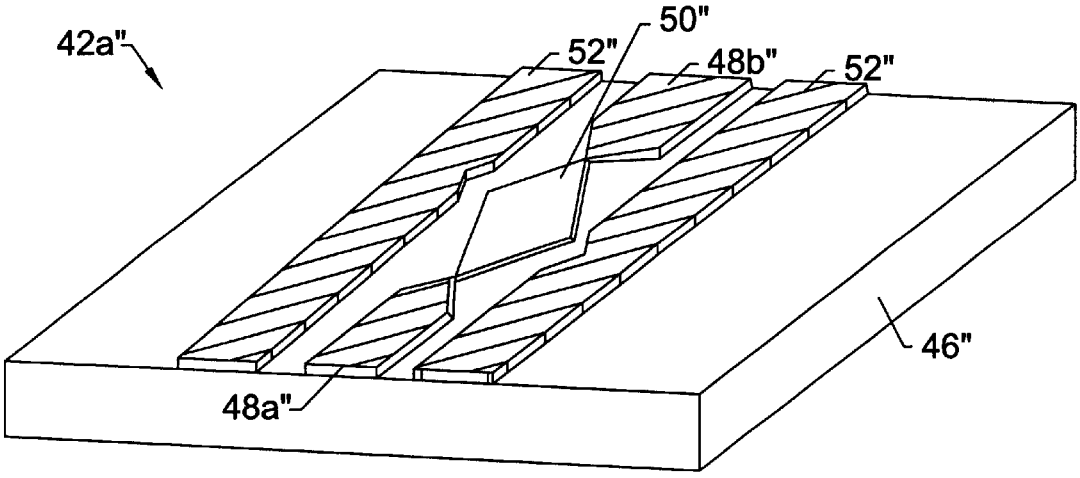

Each of the phase shifters 42*a*–42*n* further includes at least one third conductive portion 52 in a spaced apart relationship to the first and second conductive portions 48*a*, 48*b* or signal path. In one embodiment, the at least one third conductive portion 52 comprises a pair of laterally spaced apart third conductive portions adjacent the substrate 46 for defining a ground structure. The first and second conductive portions 48*a*, 48*b* laterally extends between the pair of third conductive portions 52. This defines a coplanar waveguide structure, as best shown in FIG. 5*a*. Moreover, each of the pair of laterally spaced apart third conductive portions 52" may also have a recess adjacent and corresponding to the enlarged width medial portion of the body 50", as best shown in FIG. 5*c*.

In another embodiment, the at least one third conductive portion 52' of the phase shifter 42*a*' is adjacent the substrate 46' for defining a ground structure. The first and second conductive portions 48*a*', 48*b*' vertically extend from the third conductive portion 52' for defining a microstrip structure, as will be readily appreciated by those skilled in the art, as best shown in FIG. 5*b*.

The phased array antenna 40 further includes a beam forming network 63 connected to the plurality of transmission line phase shifters 42*a*–42*n*. The beam forming network 63 includes a summing network 64 connected to the plurality of transmission line phase shifters 42*a*–42*n* for adding together signals received by the antenna elements 44*a*–44*n*. The beam forming network 63 further includes a voltage or bias controller 66 connected to the respective bias networks 68 (FIG. 3) included within each phase shifter 42. Each bias network 68 applies a voltage to a respective body 50 for controlling a dielectric constant thereof for causing the phase shift of the signal being conducting through the respective signal paths 48*a*, 48*b*.

The phase of a signal propagating through each phase shifter 42*a*–42*n* varies as a function of the applied voltage, which is typically a DC voltage. In general, the voltage applied to each transmission line phase shifter 42*a*–42*n* will be different and may vary at a predetermined rate, thereby causing the phase shifting material to produce varying and different phase shifts that result in producing a narrow antenna beam that scans a given direction.

Due to the very wide line width at the midpoint 50*a* of the body 50, the DC bias voltage may be inserted at the central point without effecting RF performance. This is because the RF fields are primarily contained under the wide conductor.

The phase shifters 42*a*–42*n* may be configured as a dedicated receive only function, a dedicated transmit only function, or a combined receive/transmit function, as readily understood by one skilled in the art.

During transmit, RF energy from the phase shifters 42*a*–42*n* drive the antenna elements 44*a*–44*n*. Because the antenna elements 44*a*–44*n* are appropriately spaced at a certain distance and are driven at different phases, a highly directional radiation pattern results that exhibits gain in some directions and little or no radiation in other directions. Consequently, the radiation pattern of the phased array antenna 40 can be steered in a desired direction.

During receive, a reciprocal process takes place. Specifically, the phased array antenna 40 feeds RF signals to the phase shifters 42*a*–42*n* where they are shifted in phase. Only signals arriving at the antenna elements 44*a*–44*n* from a predetermined direction will add constructively. The predetermined direction is determined by the relative phase shift imparted by the phase shifters 42*a*–42*n* via the voltage or bias controller 66 within the beam forming network 63 and the spacing of the antenna elements 44*a*–44*n*.

Figure 6A:
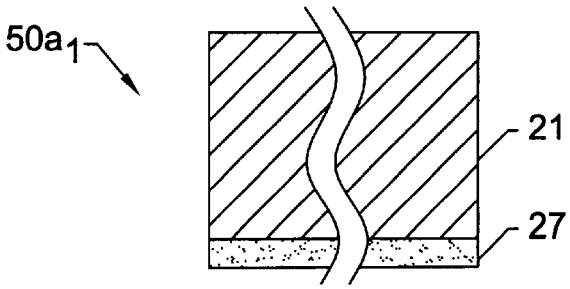
FIGS. 6*a*–6*b* are schematic cross-sectional views of a body comprising a phase shifting material in accordance with the present invention.
Figure 6B:
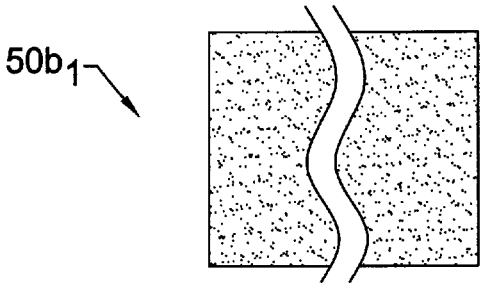

As discussed above, each body 50 comprises a phase shifting material having a controllable dielectric constant for causing a phase shift of a signal being conducted through the signal path 48*a*, 48*b*. In one embodiment, the body $\mathbf{50}a_1$ comprises a substrate 21 with a layer of the phase shifting material 27 thereon, as best shown in FIG. 6*a*. The substrate 21 may be either conductive or nonconductive. A substrate of a type having a low dielectric constant as compared to the phase shifting material having a high dielectric constant is preferable.

The layer of the phase shifting material 27 may be bonded or deposited to the substrate 21 using techniques readily known by one skilled in the art. The substrate 21 has a thickness such that the body $\mathbf{50}a_1$ may be handled by personnel and production machinery without breakage. This thickness is typically greater than 1 mil or 0.001 inches, for example. The overall thickness of the body 20 including the substrate 21 and the layer of the phase shifting material 27 is greater than or equal to 2 mils or 0.002 inches, and typically may be within a range of about 0.002 to 0.2 inches, for example.

The thickness of the layer of the phase shifting material 27 may be either thin film or thick film. Thin film has a thickness of typically a few microns. Thick film has a thickness greater than 0.001 inches, with a typical thickness in a range of about 0.001 to 0.005 inches, for example.

In another embodiment, the body $\mathbf{50}b_1$ comprises a bulk phase shifting material body, as best shown in FIG. 5*b*. In other words, the body $\mathbf{50}a_1$ is completely formed by a phase shifting material without a substrate being attached thereto. For each of the bodies $\mathbf{50}a_1$ and $\mathbf{50}b_1$ illustrated in FIGS.

6*a*–6*b*, a width is typically within a range of about 0.1 to 0.2 inches and a length is typically within a range of about 0.1 to 0.8 inches. The substrate 21 may be conductive, i.e., a metal, or may be nonconductive, i.e., a dielectric.

The use of a body 50 comprising a phase shifting material instead of a thin film phase shifting material body offers several advantages, particularly in terms of cost. Since the body 50 has an overall thickness greater than about 2 mils, i.e., 0.002 inches, the term "bulk" is used to emphasize a distinction over a "thin film" phase shifting material which typically has a thickness in the several micron range or less. The bulk characteristic of the phase shifting material body 50 allows the phased array antenna 40 to be built with the body being placed and bonded in the gap between the first and second conductive portions 48*a*, 48*b* using standard printed circuit surface mount machinery.

The substrate 46, the first and second conductive portions 48*a*, 48*b* and the at least one third conductive portion 52 can advantageously be formed using printed wiring board techniques. Because the bulk phase shifting material body 50 has a thickness that is relatively easy to handle, the bulk phase shifting material body is simply bonded to the printed wiring board in the appropriate gap to define a phase shifter 42*a*–42*n*.

Consequently, instead of individually building the transmission line phase shifters 42*a*–42*n* and combining them together to form the phased array antenna 40, the phased array antenna may be built in its entirety by forming the first and second conductive portions 48*a*, 48*b* on the substrate 46 and then bonding the bodies 50 thereto. In other words, the phased array antenna 40 according to the present invention may be scaled to any desired size, for example.

In forming the phased array antenna 40, the body 50 can be loaded into production surface mount or similar machines. This allows construction of a much lower cost phased array antenna 40. The present invention is thus very adaptable to mass production using bulk phase shifting material body fabrication techniques as readily appreciated by one skilled in the art.

A typical dielectric constant of the first and second conductive portions 48*a*, 48*b* is between about 2 to 4, and a typical dielectric constant of the phase shifting material may range between about 100 to 1,000 or more. A high dielectric constant tends to concentrate fringing fields from the RF signal paths to maximize the effect of the phase shifting material.

The phase shifting material preferably comprises a ferroelectric material, such as barium strontium titanate $Ba_xSr_{1-x}TiO_3$ or other nonlinear materials. These other nonlinear materials include $BaTiO_3$, $LiNbO_3$ and $Pb(Sr,Ti)O_3$, for example. As discussed above, the dielectric constant of a ferroelectric material can be made to vary significantly by applying a DC voltage thereto. The propagation constant of a signal path is directly proportional to the square root of the effective dielectric assuming a lossless dielectric. In addition, the phase shifting material may also comprise a ferromagnetic material.

In yet another embodiment of the phase shifter that is not shown in the figures, the phase shifting material may be placed or bonded to the substrate 46 before the first and second conductive portions 48*a*, 48*b* are formed. In yet another embodiment not shown, the first and second conductive portions 48*a*, 48*b* may be continuous without a gap therebetween. The diamond shaped phase shifting material body 50 may be placed thereon for performing its intended function.

Another aspect of the invention relates to a method for making a phase shifter 42*a*–42*n*. The method preferably comprises forming first and second conductive portions 48*a*, 48*b* adjacent a substrate 46 with a gap therebetween. The first and second conductive portions 48*a*, 48*b* define a signal path.

The method further includes inserting a body 50 in the gap. The body 50 preferably comprises a phase shifting material having a controllable dielectric constant for causing a phase shift of a signal through the signal path. The body 50 preferably has an enlarged width medial portion 50*a* tapering downwards in width towards respective end portions 50*b* for impedance matching with the first and second conductive portions 48*a*, 48*b*.

In one embodiment, the body 50 may have a diamond shape. The first and second conductive portions 48*a*, 48*b* each preferably has an impedance of about 50 ohms. The enlarged width medial portion 50*a* of the body 50 preferably has an impedance in a range of about 1 to 10 ohms. Inserting the body 50 may be performed using a surface mount machine. Each phase body 50 may have an overall thickness equal to or greater than about 0.002 inches.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A phase shifter comprising:

a substrate;

first and second conductive portions adjacent said substrate with a gap therebetween, said first and second conductive portions defining a signal path; and a body in the gap and comprising a phase shifting material having a controllable dielectric constant for causing a phase shift of a signal through the signal path, said body having an enlarged width medial portion tapering downwards in width towards respective end portions for impedance matching with said first and second conductive portions.

2. A phase shifter according to claim 1 wherein said body comprises a substrate with a layer of said phase shifting material thereon.

3. A phase shifter according to claim 1 wherein said body comprises a bulk phase shifting material body.

4. A phase shifting device according to claim 1 wherein opposing ends of said first and second conductive portions adjacent the gap have a reduced width that corresponds to a width of the end portions of said body.

5. A phase shifter according to claim 1 wherein said body has a diamond shape.

6. A phase shifter according to claim 1 wherein said first and second conductive portions each has an impedance of about 50 ohms.

7. A phase shifter according to claim 6 wherein the enlarged width medial portion of said body has an impedance in a range of about 1 to 10 ohms.

8. A phase shifter according to claim 1 wherein the enlarged width medial portion of said body has a width in a range of about 50 to 150 times a width of the end portions of said body.

9. A phase shifter according to claim 1 wherein said body has a length in a range of about 5 to 15 times an operating wavelength of the phase shifter.

10. A phase shifter according to claim 1 wherein the signal path has an operating frequency equal to or greater than about 1 GHz.

11. A phase shifter according to claim 1 further comprising a bias network connected to said body for applying a voltage thereto for controlling the dielectric constant.

12. A phase shifter according to claim 11 wherein said bias network is connected to a center portion of the enlarged width medial portion of said body.

13. A phase shifter according to claim 1 further comprising a pair of laterally spaced apart third conductive portions along opposing sides of said signal path for defining a ground structure.

14. A phase shifter according to claim 13 wherein each of said pair of laterally spaced apart third conductive portions has a recess adjacent and corresponding to the enlarged width medial portion of said body.

15. A phase shifter according to claim 1 further comprising a third conductive portion vertically spaced from said signal path for defining a ground structure.

16. A phase shifter according to claim 1 wherein said body has a thickness equal to or greater than about 0.002 inches.

17. A phase shifter according to claim 1 wherein said phase shifting material comprises a ferroelectric material.

18. A phase shifter according to claim 17 wherein said ferroelectric material comprises at least one of $Ba_xSr_{1-x}TiO_3$, $BaTiO_3$, $LiNbO_3$ and $Pb(Sr,Ti)O_3$.

19. A phase shifter according to claim 1 wherein said phase shifting material comprises a ferromagnetic material.

20. A phase shifter according to claim 1 wherein said phase shifting material has a dielectric constant equal to or greater than about 100.

21. A phased array antenna comprising:

a plurality of antenna elements; and a plurality of phase shifters connected to said plurality of antenna elements, each phase shifter comprising a substrate, first and second conductive portions adjacent said substrate with a gap therebetween, said first and second conductive portions defining a signal path, and a body in the gap and comprising a phase shifting material having a controllable dielectric constant for causing a phase shift of a signal through the signal path, said body having an enlarged width medial portion tapering downwards in width towards respective end portions for impedance matching with said first and second conductive portions.

22. A phased array antenna according to claim 21 wherein said body comprises a substrate with a layer of said phase shifting material thereon.

23. A phased array antenna according to claim 21 wherein said body comprises a bulk phase shifting material body.

24. A phased array antenna according to claim 21 wherein opposing ends of said first and second conductive portions adjacent the gap have a reduced width that corresponds to a width of the end portions of said body.

25. A phased array antenna according to claim 21 wherein said body has a diamond shape.

26. A phased array antenna according to claim 21 wherein said first and second conductive portions each has an impedance of about 50 ohms.

27. A phased array antenna according to claim 26 wherein the enlarged width medial portion of said body has an impedance in a range of about 1 to 10 ohms.

28. A phased array antenna according to claim 21 wherein the enlarged width medial portion of said body has a width in a range of about 50 to 150 times a width of the end portions of said body.

29. A phased array antenna according to claim 21 wherein said body has a length in a range of about 5 to 15 times an operating wavelength of the phased array antenna.

30. A phased array antenna according to claim 21 wherein said signal path has an operating frequency equal to or greater than about 1 GHz.

31. A phased array antenna according to claim 21 wherein each phase shifter further comprises a bias network connected to said body for applying a voltage thereto for controlling the dielectric constant.

32. A phased array antenna according to claim 31 wherein said bias network is connected to a center portion of the enlarged width medial portion of said body.

33. A phased array antenna according to claim 21 wherein each phase shifter further comprises a pair of laterally spaced apart third conductive portions along opposing sides of said signal path for defining a ground structure.

34. A phased array antenna according to claim 33 wherein each of said pair of laterally spaced apart third conductive portions has a recess adjacent and corresponding to the enlarged width medial portion of said body.

35. A phased array antenna according to claim 21 wherein each phase shifter further comprises a third conductive portion vertically spaced from said signal path for defining a ground structure.

36. A phased array antenna according to claim 21 wherein said body has a thickness equal to or greater than about 0.002 inches.

37. A phased array antenna according to claim 21 wherein said phase shifting material comprises a ferroelectric material.

38. A phased array antenna according to claim 37 wherein the ferroelectric material comprises at least one of $Ba_xSr_{1-x}TiO_3$, $BaTiO_3$, $LiNbO_3$ and $Pb(Sr,Ti)O_3$.

39. A phased array antenna according to claim 21 wherein said phase shifting material comprises a ferromagnetic material.

40. A phased array antenna according to claim 21 wherein said phase shifting material has a dielectric constant equal to or greater than about 100.

41. A method for making a phase shifter comprising:

forming first and second conductive portions adjacent a substrate with a gap therebetween, the first and second conductive portions defining a signal path; and inserting a body in the gap and comprising a phase shifting material having a controllable dielectric constant for causing a phase shift of a signal through the signal path, the body having an enlarged width medial portion tapering downwards in width towards respective end portions for impedance matching with the first and second conductive portions.

42. A method according to claim 41 wherein the body comprises a substrate with a layer of the phase shifting material thereon.

43. A method according to claim 41 wherein the body comprises a bulk phase shifting material body.

44. A method according to claim 41 wherein opposing ends of the first and second conductive portions adjacent the gap have a reduced width that corresponds to a width of the end portions of the body.

45. A method according to claim 41 wherein the body has a diamond shape.

46. A method according to claim 41 wherein the first and second conductive portions each has an impedance of about 50 ohms.

47. A method according to claim 46 wherein the enlarged width medial portion of the body has an impedance in a range of about 1 to 10 ohms.

48. A method according to claim 41 wherein the enlarged width medial portion of the body has a width in a range of about 50 to 150 times a width of the end portions of the body.

49. A method according to claim 41 wherein the body has a length in a range of about 5 to 15 times an operating wavelength of the phase shifter.

50. A method according to claim 41 wherein the signal being conducted through the signal path has a frequency equal to or greater than 1 GHz.

51. A method according to claim 41 further comprising applying a voltage to the body for controlling the dielectric constant.

52. A method according to claim 51 wherein the voltage is applied to a center portion of the enlarged width medial portion of the body.

53. A method according to claim 41 further comprising forming a pair of laterally spaced apart third conductive portions along opposing sides of the signal path for defining a ground structure.

54. A method according to claim 53 wherein each of the pair of laterally spaced apart third conductive portions has a recess adjacent and corresponding to the enlarged width medial portion of the body.

55. A method according to claim 41 further comprising forming a third conductive portion vertically spaced from the signal path for defining a ground structure.

56. A method according to claim 41 wherein the body has a thickness equal to or greater than about 0.002 inches.

57. A method according to claim 41 wherein the phase shifting material comprises a ferroelectric material.

58. A method according to claim 57 wherein the ferroelectric material comprises at least one of $Ba_xSr_{1-x}TiO_3$, $BaTiO_3$, $LiNbO_3$ and $Pb(Sr,Ti)O_3$.

59. A method according to claim 41 wherein the phase shifting material comprises a ferromagnetic material.

60. A method according to claim 41 wherein the phase shifting material has a dielectric constant equal to or greater than about 100.

* * * * *